US005634862A

United States Patent [19]

Gamache

[11] Patent Number: 5,634,862

[45] Date of Patent: Jun. 3, 1997

[54] GOLF TEE POSITIONER

[76] Inventor: Charles Gamache, 15023 - 95 Street, Edmonton, Alberta, Canada, T5E 3Z3

[21] Appl. No.: 628,499

[22] Filed: Apr. 5, 1996

Related U.S. Application Data

[63] Continuation of Ser. No. 409,158, Mar. 23, 1995, abandoned.

[51] Int. Cl.[6] ..... A63B 57/00

[52] U.S. Cl. ..... 473/386

[58] Field of Search ..... 473/386, 387, 473/398, 400, 406, 408, 132

[56] References Cited

U.S. PATENT DOCUMENTS

| | | | |
|---|---|---|---|
| 2,801,852 | 8/1957 | Hottle | 273/32.5 |
| 3,333,848 | 8/1967 | Budzinski | 223/32.5 |
| 3,540,727 | 11/1970 | Hoe, Jr. | 273/32.5 |
| 4,896,883 | 1/1990 | Wagenknecht | 273/32.5 |
| 4,982,510 | 1/1991 | Musillo | 273/32.5 |

*Primary Examiner*—Steven B. Wong

*Attorney, Agent, or Firm*—Terry M. Gernstein

[57] ABSTRACT

There is provided a device for positioning a golf tee within the ground. The device defines a flat base and at least one tee shaped recess. The recess is adapted to releasably retain in a friction fit engagement a portion of the tee therewithin. Upon withdrawal of the device from the tee, once the tee has been positioned in the ground, the tee remains at a predetermined height in the ground.

12 Claims, 3 Drawing Sheets

GOLF TEE POSITIONER

This is a continuation of application Ser. No. 08/409,158, filed on Mar. 23, 1995, now abandoned.

FIELD OF THE INVENTION

The present invention relates to a device for positioning a golf tee at a predetermined height within the ground.

BACKGROUND OF THE INVENTION

The patent literature abounds with devices functional to set a golf tee at one or more predetermined heights within the ground. Exemplary patents include U.S. Pat. No. 5,242,161 issued to W. K. Wilkinson; U.S. Pat. No. 5,033,747 issued to D. R. Young; and U.S. Pat. No. 5,052,689 issued to K. P. Lettrich.

Deleteriously, these prior art systems are often complex both structurally and in usage, typically, being formed of more than a single part, which is loosable and often breakable. It is difficult to reproduce the height of the setting of the tee.

SUMMARY OF THE INVENTION

It is an objective of the present invention to provide a simple device for positioning a golf tee at a series of accurate, predetermined heights in the ground.

It is a further objective to provide a unitary, reusable, durable device.

Broadly stated the invention is a device for positioning a golf tee within the ground which comprises: a unitary body defining a substantially flat base, and at least one recess associated with said body, said recess being adapted to releasably retain in a friction fit engagement therewith, a portion of said tee whereby upon withdrawal of said body from said tee once said tee has been positioned within the ground, said tee remains within said ground at a predetermined height.

In a preferred embodiment of the invention a plurality of recesses of differing heights are provided in a unit which fits comfortably within the palm of the hand.

DESCRIPTION OF THE PREFERRED EMBODIMENT

Figure 1:
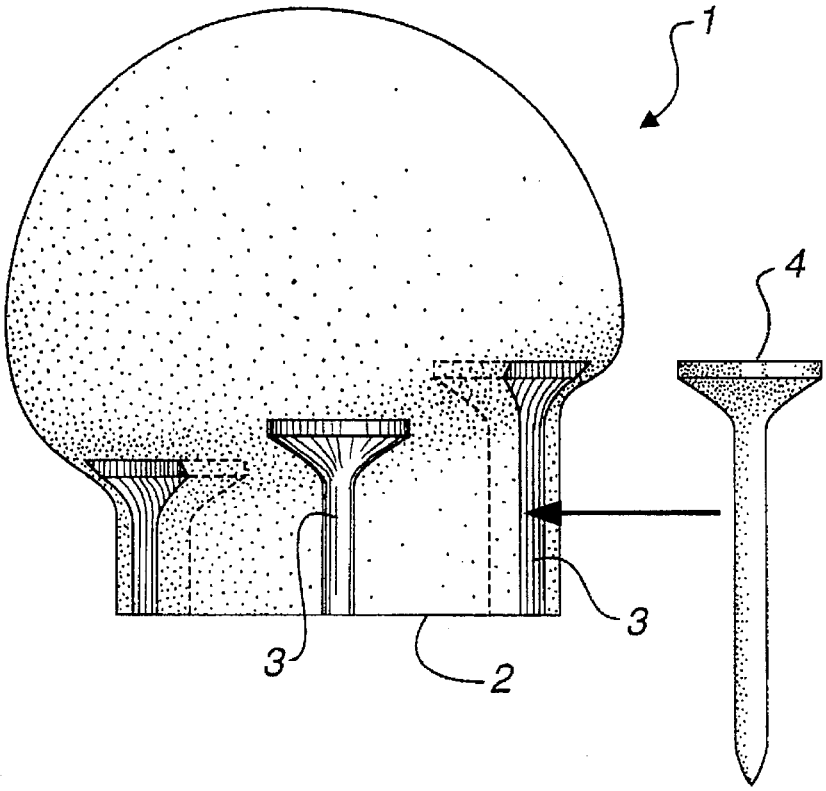
FIG. 1 is a side-sectional view of the device of the present invention.
Figure 2:
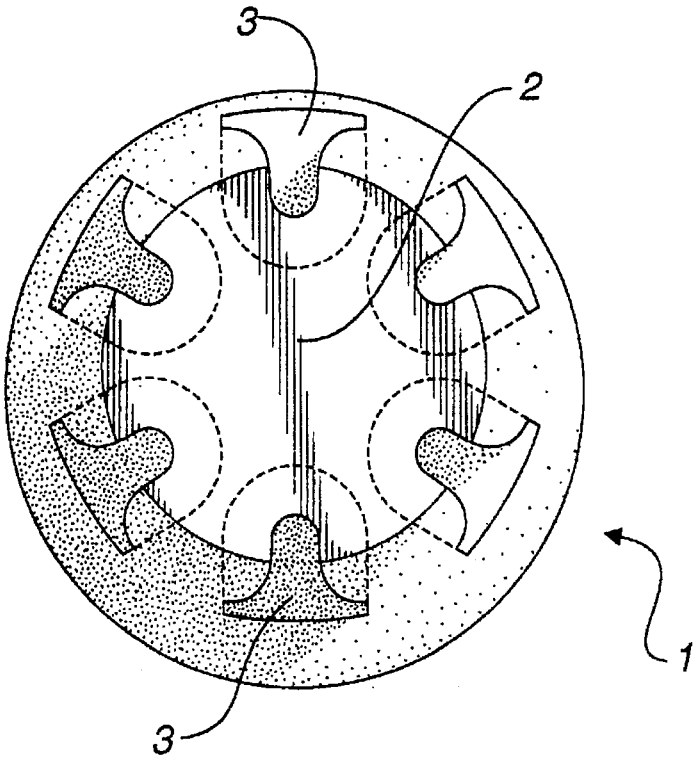
FIG. 2 is a planar view of the device of FIG. 1.
Figure 3:
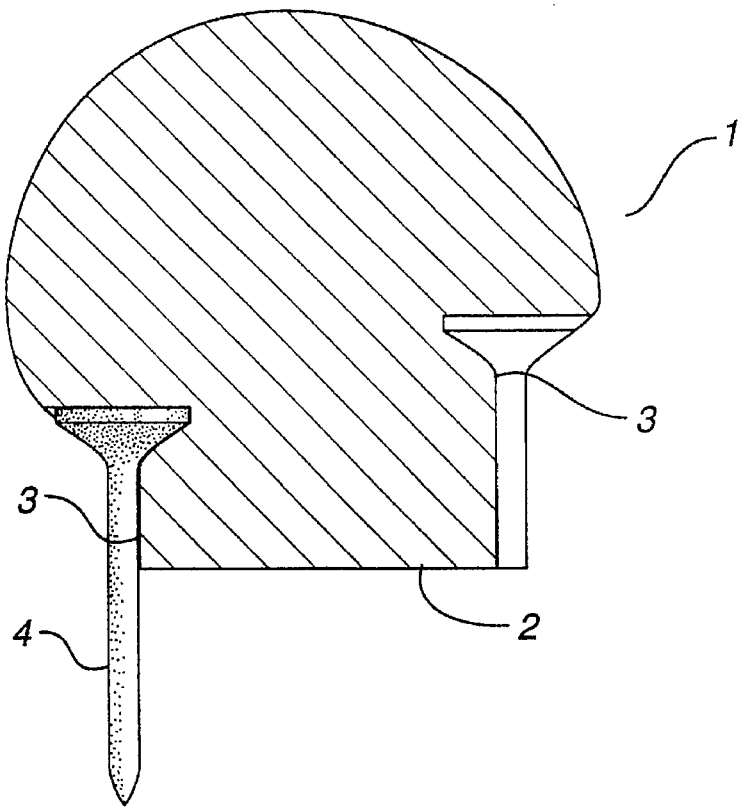
FIG. 3 is a side-sectional view of the device of FIG. 1 illustrating a golf tee fitted into one of the recesses provided in said device.
Figure 4:
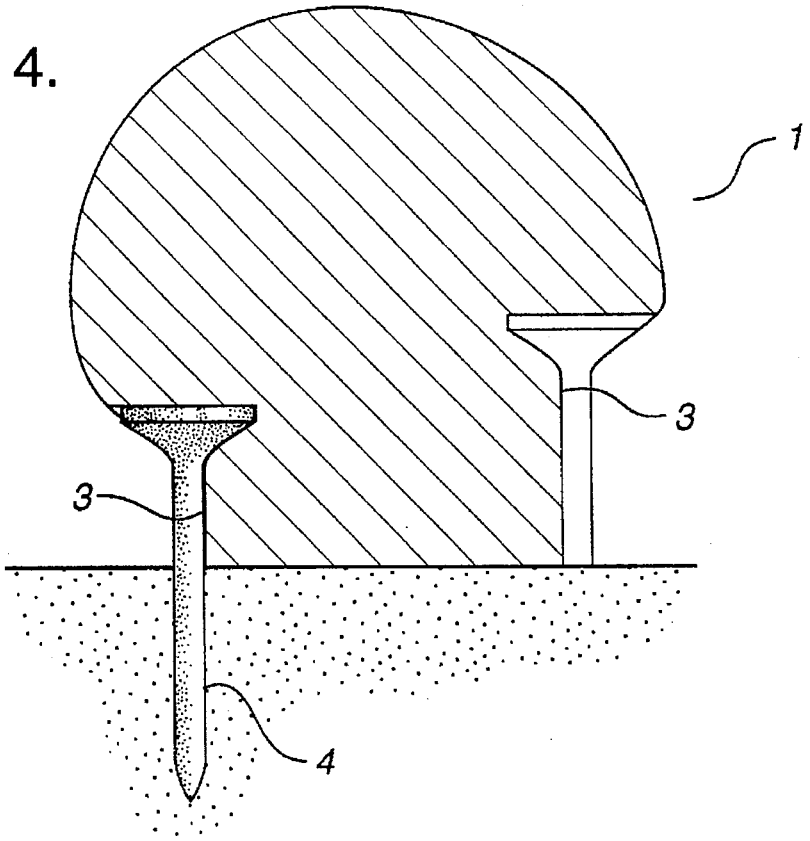
FIG. 4 is a side-sectional view of the device of FIG. 1 showing a golf tee positioned in the ground.
Figure 5:
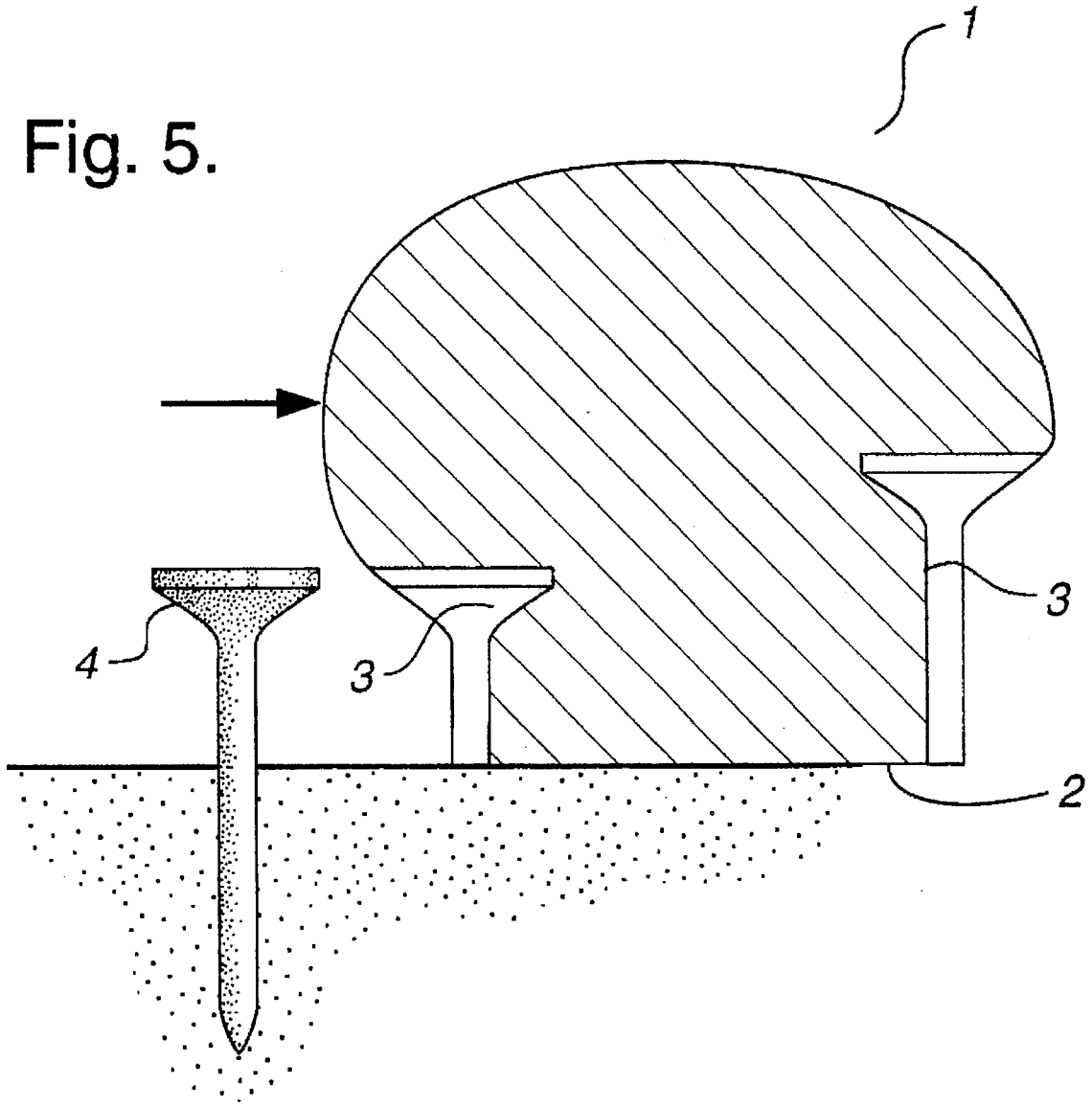
FIG. 5 demonstrates the removal of the device of FIG. 1 following placement of the golf tee in the ground at the desired height.

Having reference to the accompanying drawings, there is shown the golf tee positioner 1. The positioner 1 defines a flat base 2 and a plurality of recesses 3 of predetermined heights. The recesses 3 are functional to releasably accept in a friction fit engagement a golf tee 4. As will be evident to one skilled in the art, the recesses are substantially the shape of the tee 4 and extend to a depth approximately the width of the head of the tee 4 into the positioner 1.

The positioner 1 may be formed of any suitable material for example wood, ceramics, plastic or the like.

In summary, the device comprises a unitary body having a spherical hand-engaging portion, a cylindrical neck and a substantially flat base on one end of said neck, said neck intersecting said spherical portion at an angle with respect to said base, and at least one recess defined in said body, said recess being adapted so that said unitary body adjacent to said recess releasably retains, in a friction fit engagement therewith, a portion of said tee, said recess including a top portion defined in said hand-engaging portion adjacent to the intersection of said neck portion and said hand-engaging portion and which is conical to match the shape of a ball-supporting portion of a golf tee and has a base having a diameter essentially equal to the diameter of the ball-supporting portion and a height essentially equal to the height of the ball-supporting portion so said top portion is essentially equal in size and shape to said ball-supporting portion and a body portion defined in said neck portion which intersects said top portion at an apex of said conical top portion adjacent to the intersection of said hand-engaging portion and said neck portion and which is cylindrical to match the shape and diameter of a base portion of the golf tee, said body portion for engaging the base portion of the golf tee so the golf tee ball-supporting portion and a portion of the golf tee base portion are frictionally engaged by the unitary body adjacent to said recess whereby the golf tee is releasably held to the unitary body by frictional engagement between said unitary body and the ball-supporting portion of the golf tee and between said unitary body and said base portion, the golf tee being releasably held in said unitary body so that upon withdrawal of said body from said tee once said tee has been positioned within the ground, said tee remains within said ground at a predetermined height.

The Embodiments in which an exclusive property or privilege are claimed are defined by the claims which now follow:

1. A device for positioning a golf tee within the ground which comprises:

a unitary body having a spherical hand-engaging portion, a cylindrical neck and a substantially flat base on one end of said neck, said neck intersecting said spherical portion at an angle with respect to said base, and at least one recess defined in said body, said recess being adapted so that said unitary body adjacent to said recess releasably retains, in a friction fit engagement therewith, a portion of said tee, said recess including a top portion defined in said hand-engaging portion adjacent to the intersection of said neck portion and said hand-engaging portion and which is conical to match the shape of a ball-supporting portion of a golf tee and has a base having a diameter essentially equal to the diameter of the ball-supporting portion and a height essentially equal to the height of the ball-supporting portion so said top portion is essentially equal in size and shape to said ball-supporting portion and a body portion defined in said neck portion which intersects said top portion at an apex of said conical top portion adjacent to the intersection of said hand-engaging portion and said neck portion and which is cylindrical to match the shape and diameter of a base portion of the golf tee, said body portion for engaging the base portion of the golf tee so the golf tee ball-supporting portion and a portion of the golf tee base portion are frictionally engaged by the unitary body adjacent to said recess whereby the golf tee is releasably held to the unitary body by frictional engagement between said unitary body and the ball-supporting portion of the golf tee and between said unitary body and said base portion, the golf tee being releasably held in said unitary body so that upon withdrawal of said body from said tee once said tee has been positioned within the ground, said tee remains within said ground at a predetermined height.

2. A device as set forth in claim 1 comprising a plurality of recesses of differing heights defined around the perimeter of said body.

3. A device for positioning a golf tee in the ground comprising:

a unitary body having a planar base adapted to abut the top surface of the ground;

a cylindrical neck portion extending from said base and having a diameter;

a spherical top portion on said neck portion and having a diameter, the diameter of the neck portion being smaller than the diameter of the top portion, said neck portion intersecting said top portion to define an area of intersection;

said area of intersection being oriented at an angle with respect to said base; and a recess defined in said body adjacent to said area of intersection for frictionally holding a golf tee on said unitary body and having a cylindrical body section extending from said base to said area of intersection, said recess further including a conical top section defined in said spherical top section with an apex thereof located adjacent to said area of intersection and intersecting said cylindrical body section adjacent to said area of intersection and being sized and shaped so the unitary body adjacent to said recess releasably retains in a friction fit engagement therewith, a portion of the tee whereby upon withdrawal of said unitary body from the tee once the tee has been positioned in the ground, the tee remains in the ground at a predetermined height.

4. The device defined in claim 3 wherein said top section in the spherical top portion has a shape to match the shape of a ball-supporting portion of a golf tee and has a base having a diameter essentially equal to the diameter of the ball-supporting section and a height essentially equal to the height of the ball-supporting section so said top section is essentially equal in size and shape to said ball-supporting section and said body section matches the shape and diameter of a base portion of the golf tee, said body section engaging the base portion of the golf tee so the golf tee ball-supporting portion and a portion of the base portion of the golf tee are frictionally engaged by the unitary body adjacent to said recess whereby the golf tee is releasably held to the unitary body by frictional engagement between said unitary body and the ball-supporting section of the golf tee and between said unitary body and the base section of the golf tee, the golf tee being releasably held in said unitary body so that upon withdrawal of said body from said tee once said tee has been positioned within the ground, said tee remains within said ground at a predetermined height.

5. The device defined in claim 4 further including a plurality of recesses.

6. The device defined in claim 5 wherein each recess has a top section spaced from adjacent top sections.

7. The device defined in claim 6 wherein each recess has a body section height extending from said planar base to the apex of said top section and each recess height differs from the height of an adjacent recess.

8. The device defined in claim 4 wherein the conical section of said recess is located in said area of intersection.

9. The device defined in claim 8 further including a plurality of recesses, with the conical section of each recess being located in said area of intersection.

10. The device defined in claim 9 wherein at least two recesses are diametrically opposed with each other on said spherical top portion.

11. The device defined in claim 9 wherein said recesses are located on the outer surface of said neck portion and on the outer surface of said spherical top portion.

12. The device defined in claim 11 wherein said top portion is asymmetric.

* * * * *